US005176380A

United States Patent [19]

Evans et al.

[11] Patent Number: 5,176,380

[45] Date of Patent: Jan. 5, 1993

[54] METHOD AND APPARATUS FOR IDENTIFYING WINNING AND LOSING TOKENS USED IN PROMOTIONS

[75] Inventors: Clyde J. Evans, New Canaan; William H. Schule, Jr., Hamden; George H. Monahan, West Haven, all of Conn.

[73] Assignee: Creative Enterprises, Inc., New Canaan, Conn.

[21] Appl. No.: 717,345

[22] Filed: Jun. 18, 1991

[51] Int. Cl.[5] ..... A63F 9/00; G07D 5/08

[52] U.S. Cl. ..... 273/138 A; 194/319; 194/346

[58] Field of Search ..... 273/138 A, 139; 194/319, 323, 346, 344

[56] References Cited

U.S. PATENT DOCUMENTS

| | | | |
|---|---|---|---|
| 2,983,354 | 5/1961 | Ember et al. | 194/211 |
| 3,390,310 | 6/1968 | Peterson | 361/143 |
| 3,466,775 | 9/1969 | Smith | 273/139 |
| 3,766,452 | 10/1973 | Burpee et al. | 194/214 |
| 4,087,092 | 5/1978 | Krause et al. | 273/138 A |
| 4,307,900 | 12/1981 | Krautsack | 283/56 |
| 4,350,340 | 9/1982 | Hall | 273/153 R |
| 4,573,954 | 3/1986 | Berger et al. | 493/55 |
| 4,664,245 | 5/1987 | Maloy | 194/319 |
| 4,677,553 | 6/1987 | Roberts et al. | 364/412 |
| 4,815,741 | 3/1989 | Small | 273/138 A |
| 5,002,313 | 3/1991 | Salvatore | 283/102 |
| 5,007,641 | 4/1991 | Seidman | 273/139 |

*Primary Examiner*—Benjamin H. Layno
*Attorney, Agent, or Firm*—John H. Crozier

[57] ABSTRACT

In a preferred embodiment, method and apparatus for identifying winning and losing tokens used in a promotion which includes a machine in which one of such tokens is placed. An eddy current sensor in the machine determines the composition of the alloy of which the token is made and identifies it as a "winner" or a "loser." If the token is a winner, the machine may hold the token for manual release and verification. In one aspect of the invention, a coupon is or other object is dispensed when the token is a winner.

10 Claims, 3 Drawing Sheets

METHOD AND APPARATUS FOR IDENTIFYING WINNING AND LOSING TOKENS USED IN PROMOTIONS

BACKGROUND OF THE INVENTION

1. Field of the Invention.

The present invention relates to promotions generally and, more particularly, but not by way of limitation, to novel method and apparatus for identifying winning and losing tokens used in promotions.

2. Background Art.

Promotions are widely employed in connection with the furnishing of goods and services and take many forms. Perhaps one of the simplest promotional schemes is the distribution of discount coupons in newspapers, magazines, and separate mailings, offering the recipient cost savings on specified goods and/or services. Another scheme is the giving of a discount if a certain quantity of goods or services are purchased or if a winning symbol appears on the customer's cash register tape.

Appealing to the gambling instincts of many people, a merchant may distribute to potential customers coupons having, for example, bar codes printed thereon. The customers take the coupons to the merchant's establishment where the coupons are inserted into a machine which indicates whether the coupon is a "winner"—that is, it entitles the customer to a discount or to free merchandise or services—or otherwise the coupon is a "loser." A substantial disadvantage of such an arrangement is that bar codes are relatively easily counterfeited by readily available means.

Accordingly, it is a principal object of the present invention to provide method and means for identifying winning and losing tokens used in a promotion in which the tokens are not easily counterfeited.

It is an additional object of the invention to provide such method and means that are economically and easily constructed.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, method and means for identifying winning and losing tokens used in a promotion which includes a machine in which one of such tokens is placed. An eddy current sensor in the machine determines the composition of the alloy of which the token is made and identifies it as a "winner" or a "loser." If the token is a winner, the machine may hold the token for manual release and verification. In one aspect of the invention, a coupon is dispensed when the token is a winner.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, in which.

DETAILED DESCRIPTION OF THE PREFERRED EMBODIMENTS

Figure 1:
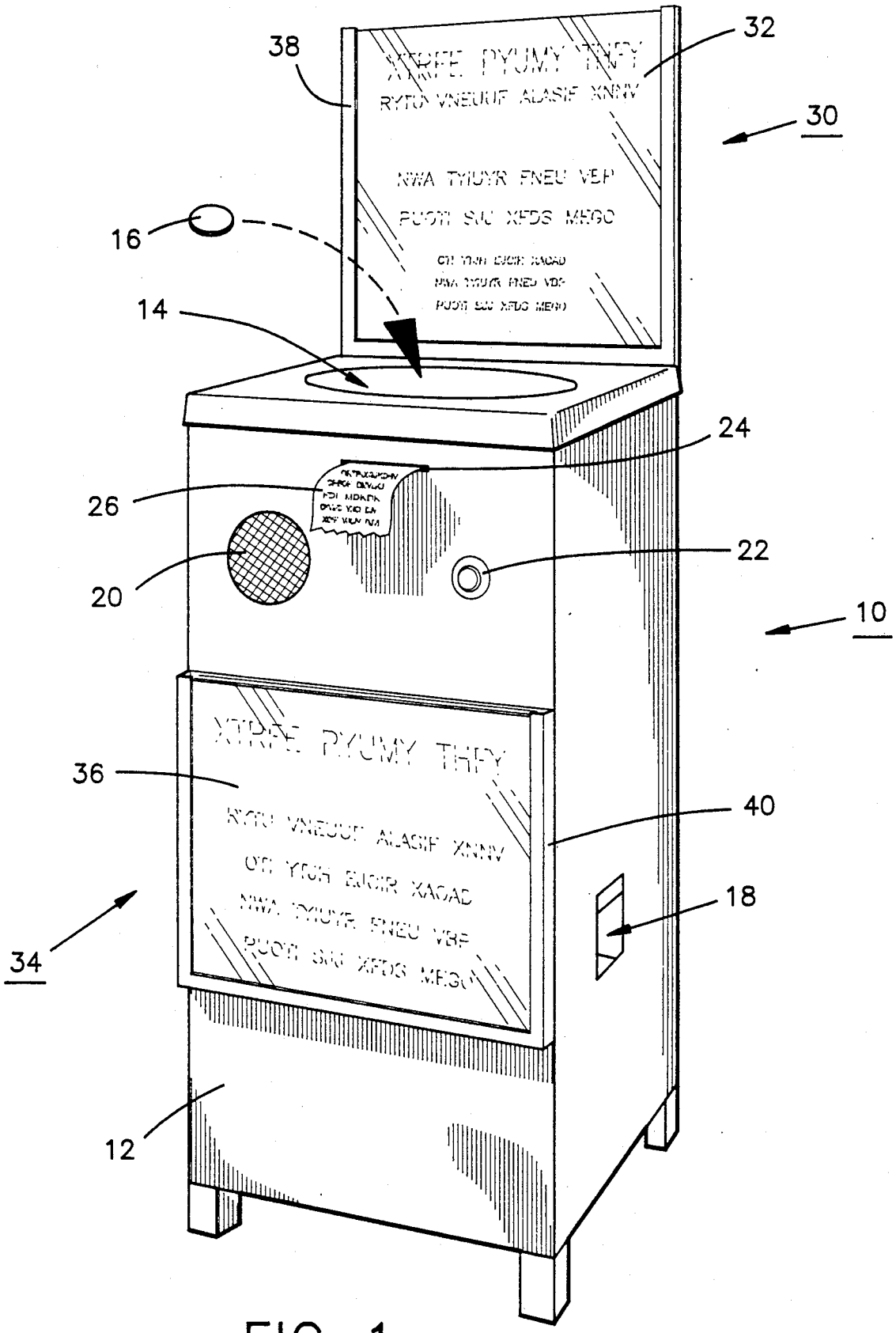
FIG. 1 is a top/side/front perspective view of a token identifying apparatus according to the present invention.

Referring now to the drawing figures, in which similar or identical elements are given consistent identifying numerals throughout the various figures thereof, FIG. 1 depicts and apparatus for identifying winning and losing tokens used in promotions, generally indicated by the reference numeral 10.

Parenthetical references to figure numbers direct the reader to the view(s) in which the element(s) being described is (are) best seen, although the element(s) may be seen also in other views.

Apparatus 10 includes a cabinet 12 having a trough 14 formed in the upper surface thereof into which trough a promotional token 16 may be inserted. Defined in a side of cabinet 12 is an opening 18 from which losing tokens can be discharged. Disposed in the front of cabinet 12 are a loudspeaker 20 and a light 22 which may be activated when a winning token is identified. Also disposed in the front of cabinet 12 is a slot 24 from which a coupon 26 may be dispensed when a winning token is identified.

Disposed upwardly from the top of cabinet 12 is a fixture, generally indicated by the reference numeral 30, which may be used to display printed promotional material 32 and a similar fixture, generally indicated by the reference numeral 34, is disposed on the front of the cabinet and may be used to display additional printed promotional material 36. Fixture 30 includes a flange 38 about the side and lower perimeters thereof to form a groove so that promotional material 32 may be conveniently slid therein from the top thereof. Likewise, fixture 34 has a similar flange 40 about the side and lower perimeters thereof to form a groove so that promotional material 36 may be conveniently slid therein from the top thereof.

Token 16 may be one of a number that have been distributed by conventional means to prospective customers by a merchant to encourage them to visit his establishment or it may be one that was given to a customer when he made a purchase. In any case, apparatus 10 would typically be located on the premises of the merchant.

Figure 2:
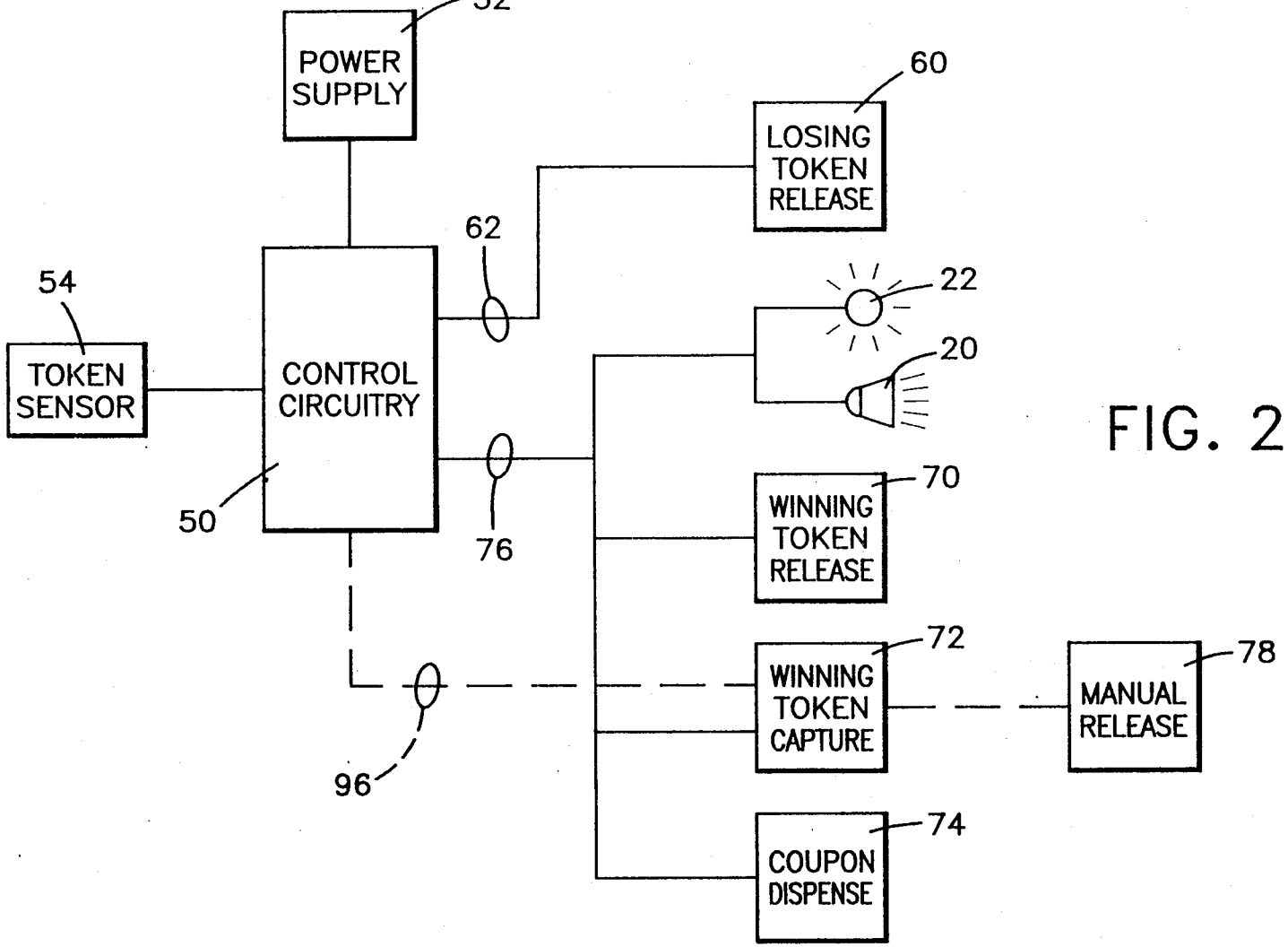
FIG. 2 is a block/schematic diagram of the electromechanical mechanism of the present invention.
Figure 4:
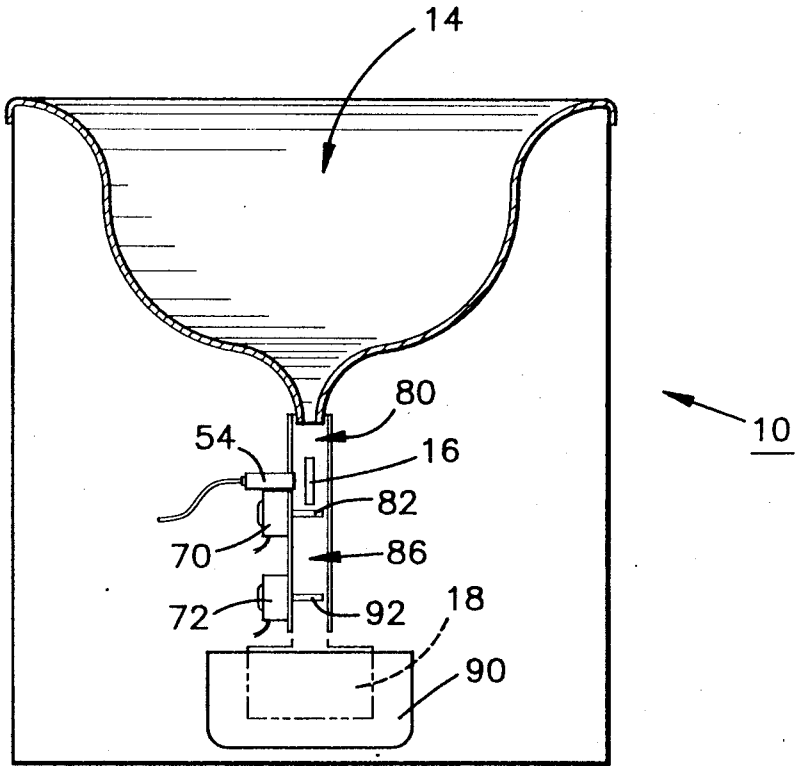
FIGS. 3 and 4 are side elevational views, partially in cross-section and partially cut-away, of the mechanism of FIG. 2.
Figure 3:
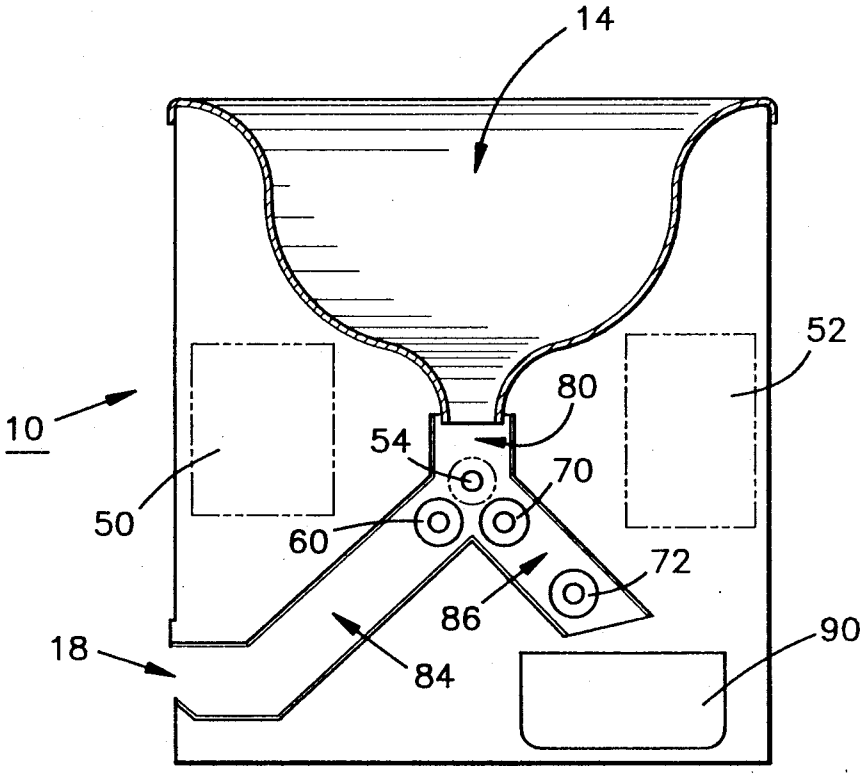

For complete understanding of the operation of apparatus 10, reference should also be made to FIGS. 2–4.

Referring first to FIG. 2, control circuitry 50 is connected to receive electrical power from a power supply 52 which may be a battery or line power or a combination thereof. Coupled to provide an input signal to control circuitry 50 is a token sensor 54 which may be a conventional eddy current sensor. The output from control circuitry 50 may be a signal to a losing token release 60 on a lead 62 or the output from the control circuitry may be a signal on a lead 76 to light 22 (FIG. 1), to loudspeaker 20 (FIG. 1), a winning token release 70, a winning token capture 72, and a coupon dispense 74. A manual release 78 is connected to winning token release 70.

Referring now primarily to FIGS. 3 and 4, after token 16 is dropped into trough 41, it falls by gravity through the trough into a primary chute 80 where, by virtue of the geometry of trough 14 and the primary chute, it is vertically aligned in proximity to sensor 54. Token 16 is held in the position shown by losing token release 60 and winning token release 70 which are solenoids disposed so that the cores thereof (core 82 of winning token release 70 shown on FIG. 4) support the token in the position shown.

If token 16 is a losing token, losing token release is activated to withdraw its core (not shown) from primary chute 80 so that token 16 will fall through losing chute 84 to opening 18 (also FIG. 1) from which it may be retrieved.

If token 16 is a winning token, winning token release 70 is activated to withdraw core 82 from primary chute 80 permitting token 16 to fall through winning token chute 86. Simultaneously, loudspeaker 20 and light 22 (FIGS. 1 and 2) may be activated to indicate that a winning coin has been detected and coupon 26 (FIG. 1) may be dispensed from slot 24 (FIG. 1). Activation of loudspeaker 20 and/or light 22 may alert the merchant in whose premises are located to award the person who inserted the token in apparatus 10 with goods or services. Alternatively, coupon 26 may be used to claim the goods or services.

In place of coupon 26 there may be substituted another object. For example, if a popular brand of beer associated with a silver bullet is being promoted, a winning coin will cause a mock silver bullet to be dispensed from cabinet 12, which mock silver bullet may be exchanged for a quantity of the beer.

Once token 16 is released into winning token shute 86, it may fall therethrough to a winning token retention receptacle 90 for later removal by an authorized person. Alternatively, when winning token release 70 is activated to withdraw its core from primary chute 80, winning token capture 72 is activated to insert its core 92 into winning token chute 86, thus preventing coin 16 from exiting the winning token chute. This permits the merchant to open cabinet 12 (FIG. 1), activate manual release 78 (FIG. 2) to cause winning token capture 72 to withdraw its core 92 from winning token chute 86, and make separate verification that token 16 is indeed a winning token. Apparatus 10 may be arranged so that regular winning tokens fall into winning token retention receptable 90, while only a grand prize token is retained by winning token capture 72. In the latter case, control circuitry 50 (FIG. 2) would control winning token capture 72 through a lead 96.

Winning and losing compositions of token 16 may be any suitable ones depending on the type of sensor employed. When token sensor 54 is an eddy current sensor, it has been found satisfactory to form losing tokens from aluminum alloy 1011 and to form winning tokens from aluminum alloy 5052. When a third alloy for a grand prize is desired, aluminum alloy 7075 has been found satisfactory. All tokens may be struck in a conventional coining process to have the same external appearance and should have ornamentation to complicate counterfeiting thereof. Should the appearance of the tokens produced from the various alloys be different in colorations, it may be desirable to have them treated, such as by anodizing, so that winning and losing tokens alike will have the same appearance.

It will be understood that counterfeiting of token 16 would be extremely difficult, since it would be necessary for a person to have known samples of both winning and losing tokens, know how to analyze them, and know how to counterfeit them.

Apparatus 10 may be constructed from any suitable materials by conventional means.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An apparatus for identifying winning and losing tokens used in a promotion, comprising:

(a) a housing into which one of said tokens may be inserted;

(b) detector means disposed within said housing to detect whether said one of said tokens is a winning token or a losing token;

(c) control means responsive to said detector means;

(d) indicator means responsive to said control means to provide an external audible or visual alarm signal if said one of said tokens is a winning token; and (e) diverting means responsive to said control means to separate said losing tokens from said winning tokens.

2. An apparatus, as defined in claim 1, further comprising: retaining means responsive to said control means to retain said winning tokens until manually released.

3. An apparatus, as defined in claim 1, further comprising: dispensing means responsive to said control means to dispense a redeemable merchandise or service coupon when one of said winning tokens is detected.

4. An apparatus, as defined in claim 1, wherein said winning tokens are of a first composition and said losing tokens are of a second composition and said detector means comprises an eddy current sensor to detect whether one of said tokens is of said first composition or of said second composition.

5. An apparatus for identifying winning and losing tokens used in a promotion, comprising:

(a) a housing into which one of said tokens may be inserted;

(b) detector means disposed within said housing to detect whether said one of said tokens is a winning token or a losing token;

(c) control means responsive to said detector means;

(d) indicator means responsive to said control means to provide an external audible or visual alarm signal if said one of said tokens is a winning token; and (e) retaining means responsive to said control means to retain said winning tokens until manually released.

6. An apparatus, as defined in claim 5, further comprising: dispensing means responsive to said control means to dispense a redeemable merchandise or service coupon when one of said winning tokens is detected.

7. An apparatus, as defined in claim 5, wherein said winning tokens are of a first composition and said losing tokens are of a second composition and said detector means comprises an eddy current sensor to detect whether one of said tokens is of said first composition or of said second composition.

8. An apparatus for identifying winning and losing tokens used in a promotion, comprising:

(a) a housing into which one of said tokens may be inserted;

(b) detector means disposed within said housing to detect whether said one of said tokens is a winning token or a losing token;

(c) control means responsive to said detector means;

(d) indicator means responsive to said control means to provide an external audible or visual alarm signal if said one of said tokens is a winning token; and (e) where said winning tokens are of a first composition and said losing tokens are of a second composition and said detector means comprises an eddy current sensor to detect whether one of said tokens is of said first composition or of said second composition.

9. An apparatus, as defined in claim 8, further comprising: dispensing means responsive to said control means to dispense a redeemable merchandise or service coupon when one of said winning tokens is detected.

10. A promotion method, comprising:

(a) distributing to a plurality of persons a plurality of tokens, some of said tokens being losing tokens and at least one of said tokens being a winning token;

(b) inserting one of said plurality of tokens into detector apparatus to detect whether said one of said plurality of tokens is a winning token or a losing token; and (c) providing an external audible or visual alarm signal if said one of said tokens is a winning token; and (d) retaining said winning token until manual release thereof.

* * * * *